US007975456B2

(12) United States Patent
Lachenmeier et al.

(10) Patent No.: US 7,975,456 B2
(45) Date of Patent: Jul. 12, 2011

(54) HOOD PACKAGING INSTALLATION WITH DEVICE FOR PRODUCING SIDE FOLDS

(75) Inventors: Per Lachenmeier, Sonderborg (DK); Karl Mangus Rasztar, Sonderborg (DK)

(73) Assignee: Illinois Tool Works Inc., Glenview, IL (US)

( * ) Notice: Subject to any disclaimer, the term of this patent is extended or adjusted under 35 U.S.C. 154(b) by 72 days.

(21) Appl. No.: 12/085,824

(22) PCT Filed: Dec. 22, 2006

(86) PCT No.: PCT/EP2006/012493

§ 371 (c)(1),
(2), (4) Date: Dec. 29, 2008

(87) PCT Pub. No.: WO2007/076983

PCT Pub. Date: Jul. 12, 2007

(65) Prior Publication Data

US 2009/0211205 A1 Aug. 27, 2009

(30) Foreign Application Priority Data

Dec. 23, 2005 (DE) ..... 10 2005 062 609

(51) Int. Cl.
*B65B 9/14* (2006.01)
*B65B 9/13* (2006.01)

(52) U.S. Cl. ..... 53/441; 53/459; 53/556; 53/567

(58) Field of Classification Search ..... 53/441, 53/459, 556, 567, 576; *B65B 9/13, 9/14*
See application file for complete search history.

(56) References Cited

U.S. PATENT DOCUMENTS 3,760,558 A * 9/1973 Kaminsky et al. ..... 53/567
3,812,644 A * 5/1974 Kamikawa et al. ..... 53/459
4,262,581 A * 4/1981 Ferrell ..... 493/188
4,481,754 A * 11/1984 Hannen ..... 53/567
5,466,210 A * 11/1995 Wilcox ..... 53/567

(Continued)

FOREIGN PATENT DOCUMENTS

DE 1278925 B1 * 9/1968

(Continued)

*Primary Examiner* — Stephen F Gerrity
(74) *Attorney, Agent, or Firm* — Levenfeld Pearlstein, LLC

(57) ABSTRACT

A method and an apparatus for wrapping articles on a pallet, in a foil hood, includes drawing off from a supply, a flat tube formed from two foil webs The webs are folded in an inward direction and directly superposed in a flat state with an integral foil The method includes opening out the end, which is to the fore in the draw off direction of the tube, at least partially sealing the length, pulled off the foil supply, essentially athwart the draw off direction at a position remote from the foremost end of the tube. The method includes cutting off the tube from the remaining foil supply at a position preceding the sealing position, drawing the tube over the articles to be wrapped, after preceding reefing of the hood or of the tube portion eventually forming it on a reefing means The method further includes forming the flat tube, after final draw off from the supply and prior to sealing being so folded inward from its outer sides in a V-shape that the two foil webs are superposed at the outer side during sealing respectively not directly but with the inclusion therebetween of a V-shaped foil fold whose fold tip extends toward the middle of the foil fold.

16 Claims, 10 Drawing Sheets

U.S. PATENT DOCUMENTS

| | | | | |
|---|---|---|---|---|
| 5,729,961 | A * | 3/1998 | Dauder-Guardiola | 53/459 |
| 6,729,109 | B2 * | 5/2004 | Knoerzer et al. | 53/459 |

FOREIGN PATENT DOCUMENTS

| | | | |
|---|---|---|---|
| DE | 1586456 | | 5/1970 |
| DE | 3242677 | C2 * | 9/1992 |
| DE | 4326827 | | 2/1995 |
| EP | 184485 | A1 * | 6/1986 |
| EP | 0252527 | | 1/1988 |
| EP | 465370 | A2 * | 1/1992 |
| EP | 0465370 | A3 | 1/1992 |
| GB | 2012711 | A * | 8/1979 |
| JP | 53065191 | A1 * | 6/1978 |
| WO | WO 02/068268 | | 9/2002 |

* cited by examiner

HOOD PACKAGING INSTALLATION WITH DEVICE FOR PRODUCING SIDE FOLDS

The invention relates to a method for wrapping a stack of palletized goods in a foil hood and an apparatus for wrapping a stack of palletized goods with a foil hood.

Generic wrapping apparatus operate either using the foil hood shrink method or in accordance with the so-called hood stretch method. In both cases a foil hood is pulled over the articles to be wrapped (as a rule downward). In the case of a foil hood shrink method the foil hood is then caused to shrink by the action of heat. Accordingly it hugs and holds the stack of goods together. In the case of the foil hood stretch method the foil hood is elastically stretched prior to, and possibly during, drawing it over the stack horizontally and/or vertically. Accordingly it is subject to a pre-tension on the stack to be wrapped and so holds it together.

An apparatus operating in accordance with the so-called foil hood shrink method of the generic type is described for example in the German patent publication DE 32 42 677 C2. The prior art apparatus is provided with a horizontal shrink frame able to travel along a stand vertically. The shrink frame is so designed that it may be employed to wrap a generally box-like or cube-like stack of goods. The foil possesses the form of a tube and comes from an endless supply roll on the rear side of the apparatus. Thence the tube travels over rolls or, respectively, rails upward above the apparatus and into a rack, which terminates above the shrink frame. In the rack there are generally means for cutting the shrink foil and welding it together. As a rule the rack also comprises a pair of rolls over which the supply of foil is moved into the machine, the rolls setting the speed with which the tube is pulled off from the supply roll. The apparatus comprises suction pockets for opening out the tube. If the next following tube is to be opened, then the suction pockets are shifted toward the foil of the tube. The two sequentially following foil portions are respectively subjected to suction by the suction pocket associated with them and accordingly opened. The foil hood is then welded at the top and cut off and then drawn over the stack of goods or, respectively, this action is completed. Then the foil is shrunk.

The foil tube employed in this apparatus for the production of wrapping hoods is a side fold tube prefabricated by the manufacturer and then rolled up on a stock roll, i. e. a foil folded flat, which in its folded condition at its two sides has V-shaped folds so that the two foil webs forming the principal faces of the foil tube do not lie on one another directly at the outer sides of the tube but rather with the inclusion or intermediate placement of a V-shaped foil fold extending at the fold apex toward middle of the tube.

Side fold tube is relatively expensive owing to its special pretreatment performed by the tube manufacturer. Furthermore side fold tube has a substantial relative thickness on the supply roll so that a roll with a maximum diameter as set by the machine only carries a smaller length (approximately 50%) than compared with the length of flat tube wound on a roll, that is to say a flat tube which consists of two foil webs integrally joined together and which are only folded through 180 degrees at their edges and accordingly lie flatwise on each other over the full width.

Accordingly machines have also been designed which instead of the completely prefabricated side fold tube are able to process so-called flat tube. Without special measures being taken there is the problem with processing flat tube forming foil hoods that following drawing the foil hood over the stack of goods two tails will be left projecting from its top side. This problem of tail formation is well illustrated in the patent publication WO 02/068268 A1, FIG. 1. This has been known for almost 40 years, see the German patent publication DE 1 586456.

These tail-like parts have an ugly appearance. They also impair the wrapping operation technically. The tail-like parts of the foil hood are prone to cause jamming or entail damage, because they stick out, during shipping and handling the goods (for example on stacking individual piles together). This means that the wrap will not protect goods against moisture. If such a shrink hood is made of shrink foil it is possible for the projecting tails in some cases to become extremely limp in the course of heating to cause shrinkage. In some circumstances, owing to their projecting, they may get too close to the heating means employed to cause shrinkage and are overheated. Be this as it may, they will at least tend to sag and in a sticky dough-like condition will come into contact with the surrounding portions of the foil. In some circumstances it may be that several layers of foil will fuse together. At that point where different foil layers melt and stick together the resulting thicker foil layer will develop extreme shrink forces. It may then be the case that the foil being excessively thin at the transition between the normal layer and the layers which are stuck together, i. e. at the end will have an excessively thin area and will sometime be torn off because of the conveying forces.

In the case of the use of such a foil hood with stretch foil there are also disadvantages. For at the tails the foil may in some circumstances become excessively loose.

In order to avoid such tails with their interfering effects the said patent publication WO 02/068268 suggests a "Posttreatment" of the wrapping on the goods. For this purpose the initially projecting tails are to be tucked in between the goods and the properly placed foil by means of special tucking elements. Such a tucking in operation requires a relatively "long stroke" movement and wastes valuable cycle time. It therefore reduces the speed of operation of the plant. Furthermore it constitutes a source of possible trouble conditions, more particularly in the case of high stroke rates. This is because the (rapid) splaying out of foil portion and the tucking in of another portion of the foil has to take place when the foil is already drawn over the goods and is therefore already more or less drawn tight. There is consequently a considerable danger of the foil tearing in the splayed out portion. Tears in the foil however to be avoided at all costs. In fact they lead to the plant detecting a trouble condition in some circumstances and being automatically switched off.

In view of this one object of the invention is to provide a wrapping method and, respectively, to provide a wrapping apparatus, which while producing the foil hoods from a flat tube avoids the formation of typical interfering tails on the finished foil hood and does without an undesired post-treatment of the foil hood drawn over the stack of goods in order to discard such tails.

Such a wrapping method is achieved in that the tube employed in the form of a flat tube is only so V-folded following the final draw off from the supply and prior to sealing, starting at its outer sides that the two foil webs lie on each other at the level of the seal during sealing, respectively, not directly but with the inclusion of a V-shaped fold with the fold tip or edge extending toward the middle of the tube and such sealing is so performed that the V-shaped folds and the immediately adjoining portions are secured in the seal portion in relation to each other.

It is in this manner that the tube is neatly folded prior to sealing, in the portion in which it is later sealed. The inwardly folded portions of the foil, which would otherwise be superfluous and would have lead to tail formation, are secured and anchored in the course of sealing of the tube. In the following drawing over the goods (or possibly the completion of this operation) in this fashion the formation of a tail is ruled out from the start. The later removal of tails is unnecessary.

One of the decisive advantages in this case is that the method employs a flat tube for the production of the foil hood. For plain flat tube is substantially more practical than prefabricated side fold tube and moreover more adaptable in its applications because the field of use of a prefabricated side fold tube is limited by the selected size of the side folds. Nevertheless despite the use of a flat tube there is no sacrifice as regards the quality of the finished wrap.

Furthermore as regards the number of load units wrapped per hour there are advantages in any case. Since on a roll, whose maximum dimensions are definitely set, a substantially greater length of foil is wound, the intervals, in which the wrapping process halted for this purpose of changing the roll of foil, are approximately 50% shorter. If now the required V-shaped folds extend over the entire length of the tube in a continuous method (normally without any additional movement being necessary), there is a clear advantage as regards time. The same will apply when folds are only produced locally and an additional local heating of the tube is not performed. Even if the additional movement of "locally pulling and tucking in the tube" is performed in order to produce particularly exact folds, there is on balance a certain gain in time.

In order to produce exact folds the tube so opened prior to tucking at its corresponding level that here it forms a generally four-cornered tube cross section. Following this using suitable folding members the foil is folded at two sides of this generally four-sided tube cross section in a V-like manner toward the middle of the tube. Then the tube cross section is reduced in size so that at those sides, which are shifted inward, there is respectively a V-shaped fold pointing toward the middle of the tube cross section and between the two other sides delimiting the tube cross section.

It is in this manner that it is becomes quite simply possible to produce more particularly V-shaped folds in the form of a simple letter "V" exactly and without any interference, the term V-shaped being understood functionally and as describing the principle of the fold. A V-shaped fold can for example also be in the form of a double concertina-like "V". It is however preferred to have a V-shaped fold in the form of a simple letter V. Such a fold may be produced substantially more simply and reliably. It will be obvious that the V of a V-shaped fold will have limbs practically pressed out flat as soon as the foil tube, after production of the folds, is laid flat again, possibly temporarily completely, for example to be supplied over further drive or bend rolls to the portion of the machine in which sealing, severing or the like takes place.

Preferably in this case the sides of the tube cross section, which are not shifted inward to form a V-shaped fold, are laid on top of each other. Thus during production of the V-shaped folds a monitored foil tension may be maintained so that neat folds are produced without any danger of overtraining the foil.

Ideally the size of the two V-shaped folds (i. e. the distance between the apex of the V and the end of the two limbs of the V) is set by selecting the length of the two sides of the tube cross section produced, when the V-shaped folds are moved together and placed on top of each other and receive the V-shaped folds between each other, prior to the start of folding in a suitable manner. Accordingly it becomes possible to adapt the size of the side folds and accordingly the size of the foil hood in an ideal manner to the shape of the respective goods to be wrapped. While namely practically ideally four-sided goods in practice require no or relatively small V-shaped folds, in the case of goods considerably departing from a square shape and with a clearly rectangular shape it is necessary to provide relatively large V-shaped folds in order to avoid the formation of tails. An optimally adapted size of the V-shaped folds is in particular also important for the resistance to tearing or durability of the foil hood in the seal area. If namely the V-shaped folds are not correctly dimensioned, then there will be substantial tension forces at, for example at the weld seam closing the foil hood at the position of the transition from four to two layers. Such forces entail tears and possibly even complete bursting of the foil hood. This danger exists to a considerable extent with stretch foil hoods. There is at least a tendency for this at positions where the foil hood is shrunk at a weld seam which badly fits after drawing over the goods and where it is subjected to tension.

In accordance with a preferred method of folding the start, left behind after the sealing and cutting off of the previous foil hood, of the foil tube connected with the foil supply (or the beginning of a just inserted foil tube), is opened and reefed on a drawing over means so that the foil tube merges at a generally roof-like portion of the cross section (roof portion) of its reefed out portion with its as yet unopened portion after which two mutually opposite sides of the roof portion are folded in a V-shaped manner and then the roof portion, in its portion intended for sealing with the inclusion and further shaping of the V-shaped folds, is folded flat and then sealing takes place preferably by welding.

Accordingly separate opening of the tube cross section in the portion in which the folds are to be produced is no longer needed. For such folding takes place here adjacent to the roof portion, which in any case is opened by reefing the foil of the tube. Accordingly the cycle speed may be further increased, because an otherwise necessary additional working step is saved. Although the folds produced here will be possibly less neat, since they are not positively guided as far as the end, this however can be tolerated for the sake of having faster cycle times.

Preferably the foil tension at roof portion is influenced during folding by drawing off a further length of flat tube with the feed rolls from the supply so that simultaneously a further length of tube is available at the roof portion. For on folding the foil is pulled tight at the roof portion. If foil is added in the manner described, overloading of the foil at the roof portion is avoided.

It is furthermore preferred, in addition or alternatively, for the same purpose to influence the foil tension in the roof portion by drawing off a length of tube from the already reefed portion of the tube, same being available at the roof portion.

A further preferred embodiment of the method is such that the production of the V-shaped folds takes place continuously and in such a manner that prior to drawing from a new tube supply a portion of the tube is clamped in a sealing manner at either side in the transverse direction, inflating gage pressure is applied to this tube portion and the gage pressure is moved along the tube further and further and is essentially maintained. It is in this manner that the respectively fresh tube portion from the supply is inflated. It may then following this be moved along two folding members and be thrust inward by them inward in a V-shape. As soon as the tube portion is thrust together again in order to displace or, respectively, redirect the inflating air into a tube portion following it, the inwardly thrust portions are respectively folded to produce a V-shaped fold. This continuous method does have the advantage of permitting extremely fast folding. As soon as once (in the case of the start of a layer or, respectively, on starting a new foil roll) an inflating gage pressure flow is directed into the tube, folding takes place automatically as soon as tube is drawn off from the foil roll without any foil tenters or foil folding members having to be reciprocated. Although in some cases the foil is loaded by sliding against the folding members. In view of the further advantages of this method however the additional load on the foil can be tolerated many applications.

Further advantages feature and details of the invention will be gathered from the following detailed account of a working example with reference to the accompanying drawings, which are purely diagrammatic.

FIGS. 1 to 5 show such a known means for opening a foil tube using foil tenters.

FIG. 6*a* is a view from above of such an inherently known means for opening the foil hood just at the moment when the foil tenters are starting to act in accordance with a first working example.

FIG. 6*b* shows the arrangement of FIG. 6*a* in s side elevation.

FIG. 7*a* shows the cooperation of the foil tenters and folding members in accordance with FIGS. 6*a* and 6*b* in an advanced stage of folding in two sides of the foil tube.

FIG. 7*b* is a side view of the arrangement of FIG. 7*a*.

FIG. 8*a* shows the cooperation of the foil tenters and folding members (shown in FIGS. 6*a* and 6*b*) after the completion of folding and the foil hood as seen in the draw off direction preceding (above) the foil tenters and the folding members is being welded together and cut up.

FIG. 8*b* shows the arrangement of FIG. 8 in a side elevation.

Figure 1:
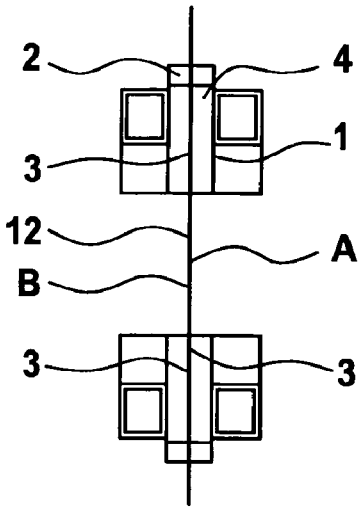
FIG. 1 (Prior Art)

It is a feature common to all working examples of the invention to be described that the wrapping apparatus and its main components may be generally arranged as in FIG. 1 of the said German patent publication DE 32 42 677 C2, whose subject matter is here included by reference. When the wrapping apparatus is designed in the form of a shrink foil system it will have the shrink frame illustrated in the said publication. Otherwise it will for example be provided with a reefing frame for reefing out, transversely stretching and vertically stretching the foil hood (vertical stretching occurring during drawing over the goods, during which the drawing off of the foil is "braked"in a controlled manner).

The means for producing the V-shaped folds which in the present case comprise the foil tenters, about to be described, and the folding members associated with them, in the first two working examples are arranged in the draw off direction of the foil tube behind the feed rolls 13 (which in the case of the said German patent publication DE 32 42 677 C2 are integrated in the rack 5) and above the level of the largest pile of goods to be wrapped. In the third working example the means for producing the V-shaped folds are mounted as considered in the draw off direction of the foil tube preceding the (last) feed rolls. In FIG. 6*b* and the other figures representing the two first working embodiments in a corresponding manner, the supply rolls are referenced 13.

The foil tube is at this time (on the basis of the figures) either opened and at least partly pulled over the goods. Alternatively the tube, for example when the plant is designed to implement a hood stretch method, reefed out on the reefing members. In either case the top end of the foil tube is at the point in time to be considered still joined with the stocked flat tube.

The foil tenters are now shifted so far in a horizontal direction that they are (as considered in the draw off direction) just behind the portion sealed later to form a foil hood, of the foil tube. The foil tube is at this point at least partly practically entirely unopened, i. e. the two foil webs constituting the flat foil tube are superposed in a planar manner.

The foil tenters are in principle so designed as described in the German patent publication DE 43 26 827 A1, whose subject matter is here included by reference.

Each of the foil tenters (2 and 4) consists of a suction pocket 4 having a suction/tenter element 2. Each suction pocket has a suction face 3 on its side facing the foil. The pocket has a suitable opening, which is covered by a grid. The suction tenter element 2 is mounted so that it may pivot on the suction pocket 4.

As soon as the four suction pockets 4 of the foil tenters have been shifted into contact with the foils, by switching on the corresponding suction fan vacuum is applied so that the foil webs A and B are thrust sequentially in portions against the suction faces 3. FIG. 1 shows a snapshot of this situation.

Figure 2:
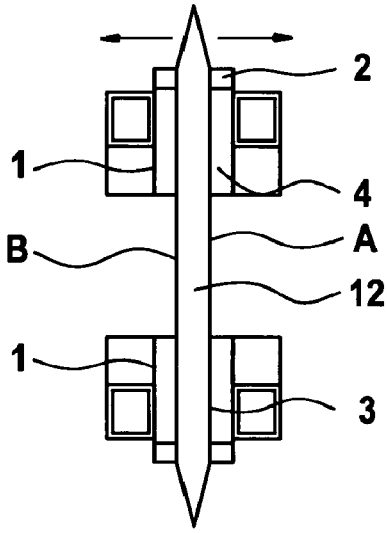
FIG. 2 (Prior Art)

Then next the foil tenters are shifted apart in pairs in a horizontal direction. Each of the foil tenters entrains the foil thrust against the suction face 3 of its suction pocket 4 so that the foil tube is opened up at an initially small cross section between the foil webs A and B as is in fact illustrated in FIG. 2.

Figure 3:
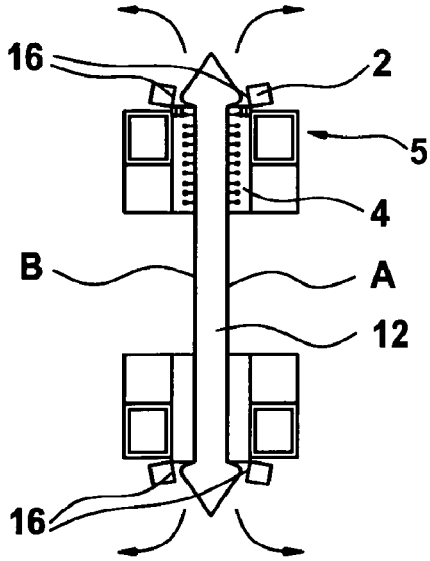
FIG. 3 (Prior Art)
Figure 4:
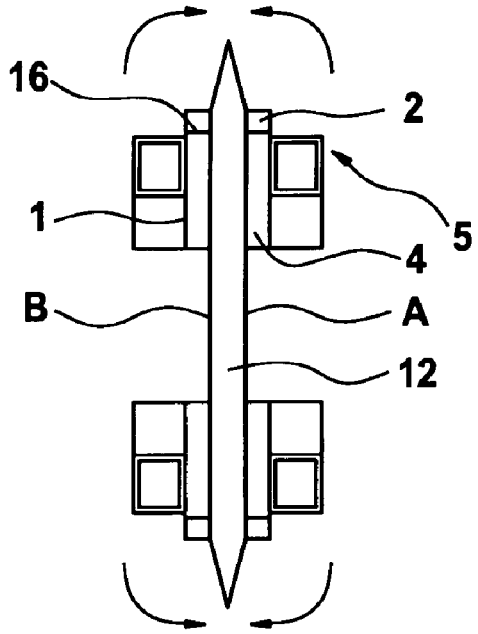
FIG. 4 (Prior Art)

Then the suction tenter elements 2, which are mounted for pivoting motion on the suction pockets 4 are tilted back through an angle of preferably less than 90 degrees away from the foil. Accordingly they uncover a suction opening on the respectively outwardly turned end side of the respective suction pocket 4. The portions, projecting outwardly past from the cross section delimited by the four foil tenters of the foil webs A and B are accordingly subjected to suction by the uncovered end sides of the pockets 4. Thus the foil enters the nip, which has now opened owing to the pivoting back of the suction and tentering elements 2 between the same and the end sides of the suction pockets 4, see FIG. 3. The suction and tenter elements 2 are now pivoted back in their original position and so come into engagement with the end sides of the suction pockets 4. This means that the respective foil portion lying on the outwardly turned end side of the pocket is gripped. The foil tube which has so far only be splayed to a small cross section is now no longer held by the suction action and is primarily mechanically "tentered" because it is gripped at four points as is in fact illustrated in FIG. 4.

Figure 5:
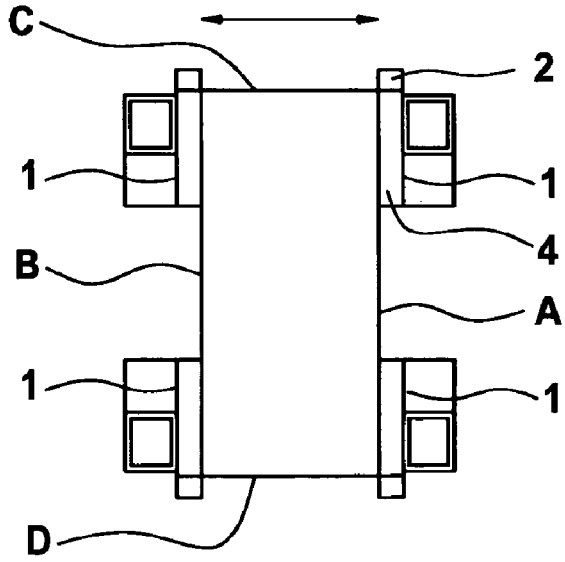
FIG. 5 (Prior Art)

Following this the foil tenters are further shifted in a horizontal direction in pairs away from each other so that the flat tube is now opened out to have a generally four cornered cross section as is depicted in FIG. 5.

So far the handling of the foil tube is in principle the same as the handling suggested in the German patent publication DE 43 26 877 A1, but however with the difference that here no prefabricated side fold tube is being opened, but rather a plain and more economic flat tube which is substantially more adaptable in production.

At those sides C and D, on which there is substantially no direct action of the foil tenters, the folding members are caused to engage by feed in a generally horizontal direction. The folding members are in this case designed in the form of narrow folding plates 14 extending in an elongated manner perpendicularly to the plane of the drawing. FIG. 6*b* shows this in a side elevation and FIG. 6*a* shows it in the view from above along that section plane A-A, which is marked in FIG. 6*b*.

Figure 7A:
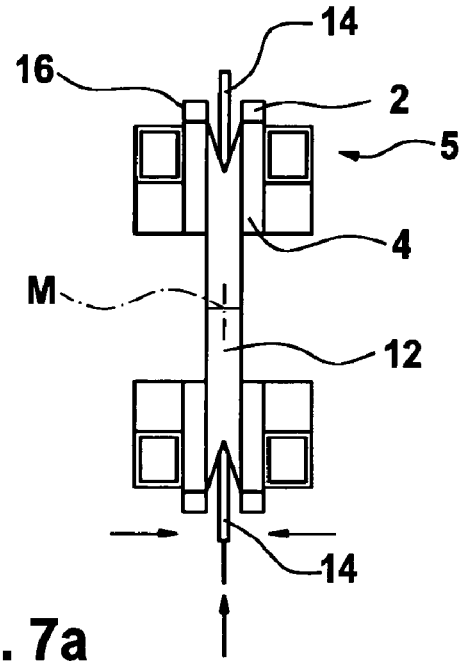
FIG. 7a (Prior Art)
Figure 7B:
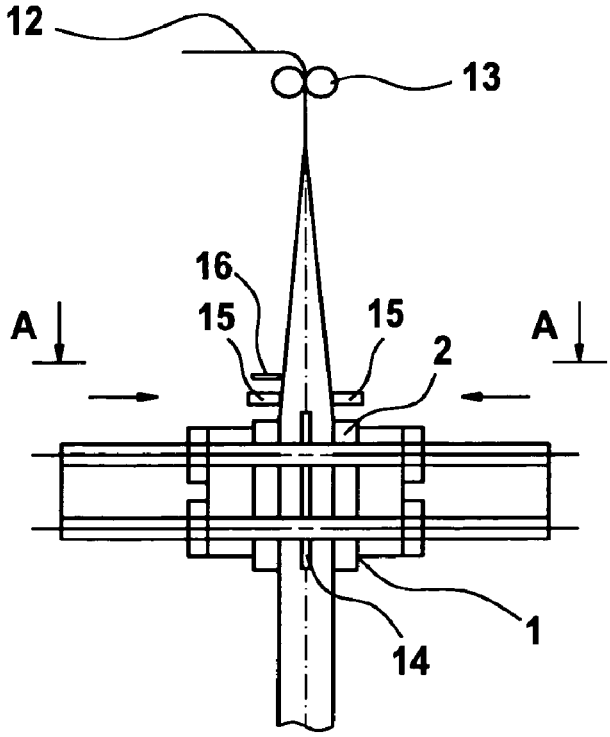
FIG. 7b (Prior Art)

The folding plates 14 are now shifted on further horizontally toward the middle of the foil tube which is splayed out generally as a quadrilateral. In this manner they fold the foil tube, opened out generally as a quadrilateral, from two of its outer sides C and D toward the middle of the hood in a V-shaped manner. During such inward folding the foil tenters are shift toward each other in pairs in a horizontal direction so that the tension of the V-folded in sides (caused by the folding plates 14) of the foil tube is held in a controlled manner, or, respectively, in any case overstretch of the foil is avoided. This operation is depicted in FIG. 7*b* as seen from the side, while FIG. 7*a* shows it from above and FIG. 7*b* indicates it in a section plane marked A-A.

Figure 6A:
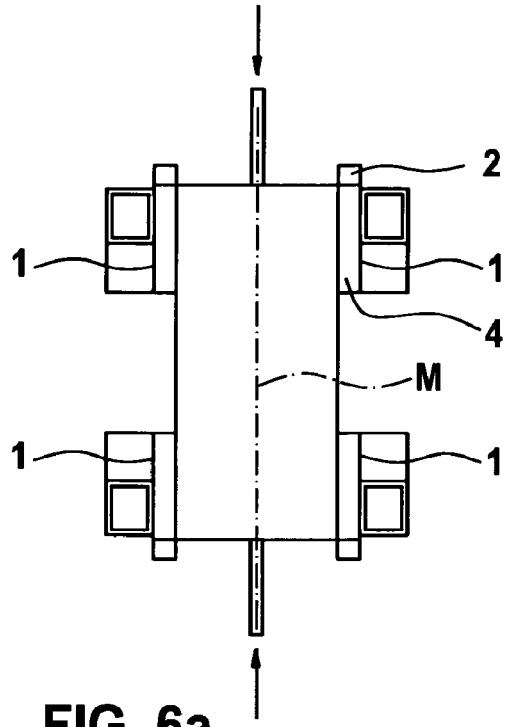
FIG. 6a (Prior Art)
Figure 6B:
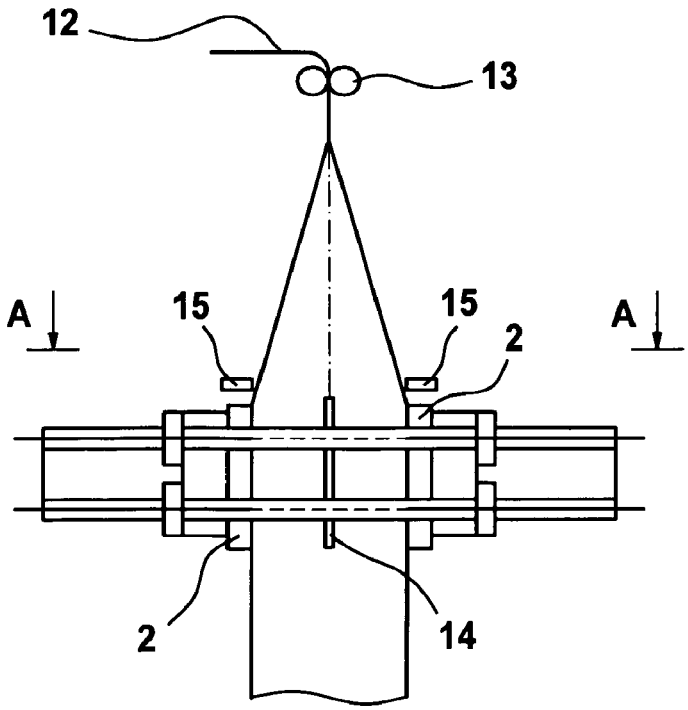
FIG. 6b (Prior Art)
Figure 8A:
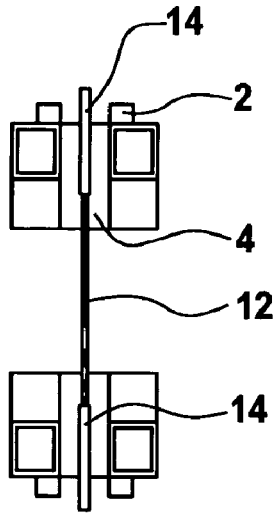
FIG. 8a (Prior Art)
Figure 8B:
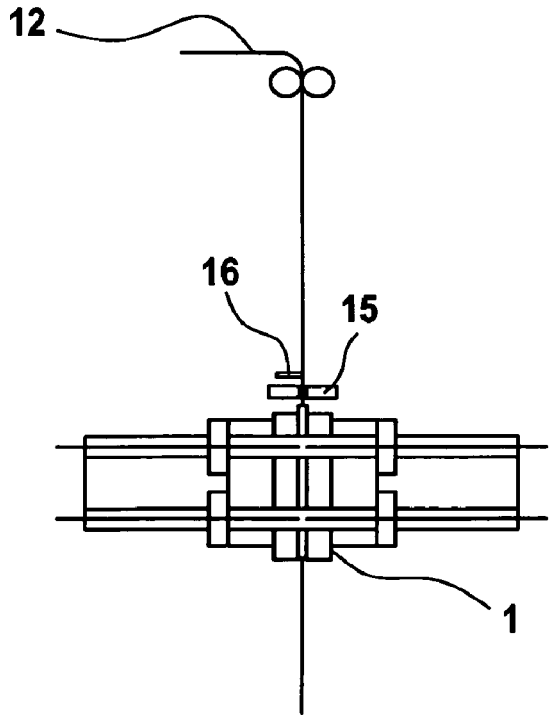
FIG. 8b (Prior Art)

Lastly FIGS. 8*a* and 8*b* show the position (as previously illustrated from the same vantage point in the already explained FIGS. 6*a* and 6*b* and, respectively, 7*a* and 7*b*) in which the two V-shaped folds are completely formed. If the situation is now such that the flat foil tube, previously opened out as a quadrilateral, is folded inward in a V-shaped manner, at its outer sides C and D (which had a 180 degree fold). The two broad foil webs A and B held by the suction pockets 4 or respectively by the suction/tenter means 2, opposite to each other now do not lie on top of each other directly but with the inclusion between them of a respective V-like foil fold extending toward the foil center.

This V-shaped fold is here not only present at the foil tenters 2 and 4 but also extends upward at least into that part, which is now to be sealed, i. e. at the level at which the seal is eventually to be made.

Now, as shown in FIG. 8*b*, the sealing means 15 is activated. As a matter of principle sealing may take place in many different manners, f. i. by folding over and/or stapling. Ideally a weld seam is however made, which properly extends over the full width of the foil tube, although this is not absolutely mandatory. Whatever the manner sealing, the operation is always so performed that the V-shaped folds and the immediately surrounding parts of the foil webs A and B are secured in relation to each other. Accordingly it is possible to avoid a reopening of the V-like folds in the sealed portion of the tube.

Then the tube, is cut off from the rest of the tube stock preceding the sealing means as considered in the draw off direction. For instance a horizontally moving blade 16 can cut through the tube. Alternatively a hot wire may be employed.

Now it is possible for the finished foil hood to be pulled over the goods, or, respectively, for the already started action of pulling over the goods to be completed.

It is an advantage if the foil tenters 2 and 4 are so designed and able to be so shifted that they may be employed both to open, the outer end, as considered in the draw off direction, of the hood and to render it able to be pulled over the goods and also to open the hood at the level of the eventual seal (just underneath it) and thus to produce folds in cooperation with the folding members 14.

It is to be stressed as well that in the case of the first embodiment described here V-shaped folds are only produced locally at the eventual point of sealing. This avoids damage to the foil and is a safeguard against unnecessary tearing of the foil, which delays the entire process. For it is not necessary to produce V-shaped folds along the full length of the eventual foil hood. This is because the latter are in fact drawn open again outside the immediate proximity of the seal during pulling the hood over the goods. The reason for this is that clear of the immediate proximity the full cross section of the foil is employed to wrap the goods.

If the foil tenters 2 and 4 are so designed that they may be shifted toward and away from each other in pairs in a first horizontal direction and that they may travel in pairs (but with different partners i. e. in different pairs) in a second horizontal direction, toward and away from each other, then there is an extremely simple manner of setting the desired size of the V-shaped folds when they are made. Thus it is possible to produce V-shaped folds with an optimum size and an individual adaptation to the cross section of the respective goods to be wrapped so that the foil hood produced for these goods to be wrapped has an optimum fit.

Figure 9:
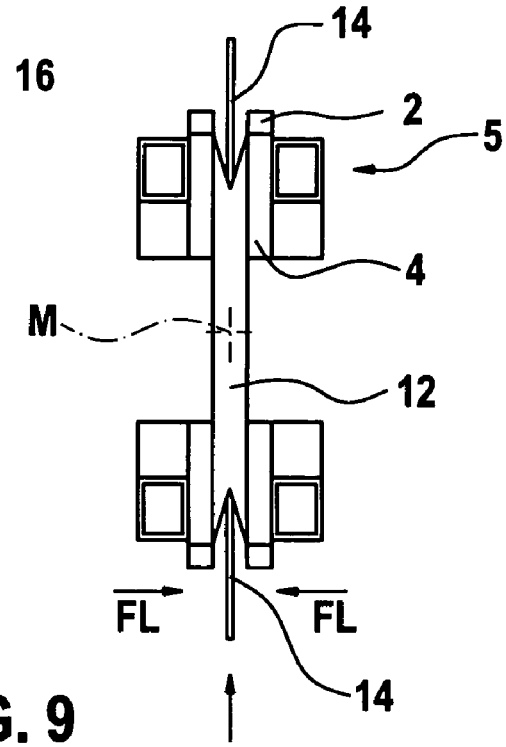
FIG. 9 shows the foil tenters and folding members of the first working example in a modification in which the foil tenters are moved about two axes in the horizontal plane in order to set the size of the V-shaped folds and in this case have so traveled that only small V-shaped folds are produced.
Figure 10:
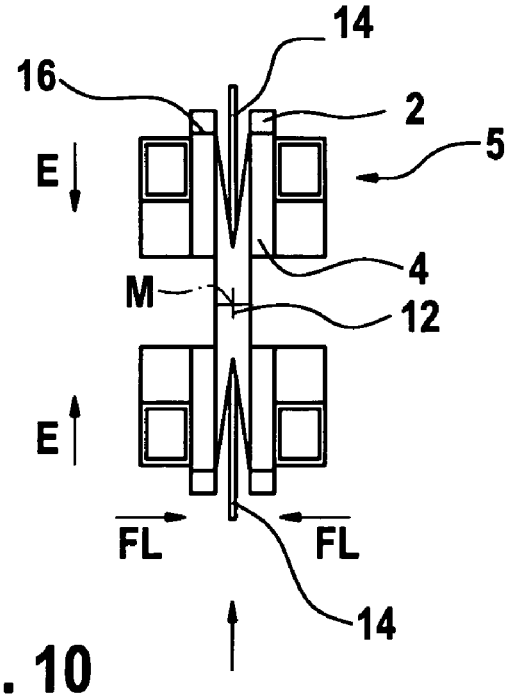
FIG. 10 shows the foil tenters and folding members of FIG. 9, the foil tenters in this case being so-positioned that large V-shaped folds are made.

FIGS. 9 and 10 show this. While FIG. 9 shows how relatively small V-shaped fold are produced, FIG. 10 shows the formation of a relatively large V-shaped folds.

For this purpose the foil tenters were shifted out of the position previously assumed for folding in the frame depicted in FIG. 9, prior to producing fold for the next hood along the arrows E, see FIG. 10. The sides A and B of the foil hood gripped and held by the pockets 4 and, respectively, the suction/gripper means 2, are now shorter. Accordingly the V-shaped folds may be pulled in from the longer sides C and D further inwardly toward the middle of the tube because the folding plates 14 are shifted inward further toward the middle M of the hood.

In the same manner and by suitable drawing apart of the foil tenters along axes marked by the arrows E, foil hoods may be produced having smaller V-shaped folds.

The foil tension is controlled in either case, as described above, by yielding in the direction of the arrows F.

Such a design of the foil tenters 2 and 4 renders possible furthermore the processing of foil tubes, which have different widths right from the outset. This ensures a high degree of flexibility. For it is not in all cases possible using a single flat tube to produce optimum results and using one and the same width simply by varying the fold size.

Variability as regards the size of the V-shaped folds involves substantial advantages. Where previously it was either necessary to change the roll of foil or machines were necessary holding different foil rolls at the ready, presently a machine is sufficient with a single roll stock. Accordingly not only is the machinery less complex and the quality of the wraps improved but also the cycles are faster. This applies even if the goods to be wrapped have considerable variations in their dimensions. Also retooling the machine (even if it should be possible) is in every case unnecessary. As soon as the sensors for the goods have found the cross section of the goods to be wrapped, they send corresponding signals to the machine controller, which for its part computes the mandatory size of the V-shaped folds and then takes the necessary measures, as for example travel in pairs of the foil tenters along the arrows "E" and "FL" into the required position. The resulting motion takes place biaxially-projected onto an imaginary biaxial coordinate system placed horizontally in space. The folding members are suitably controlled.

Figure 11:
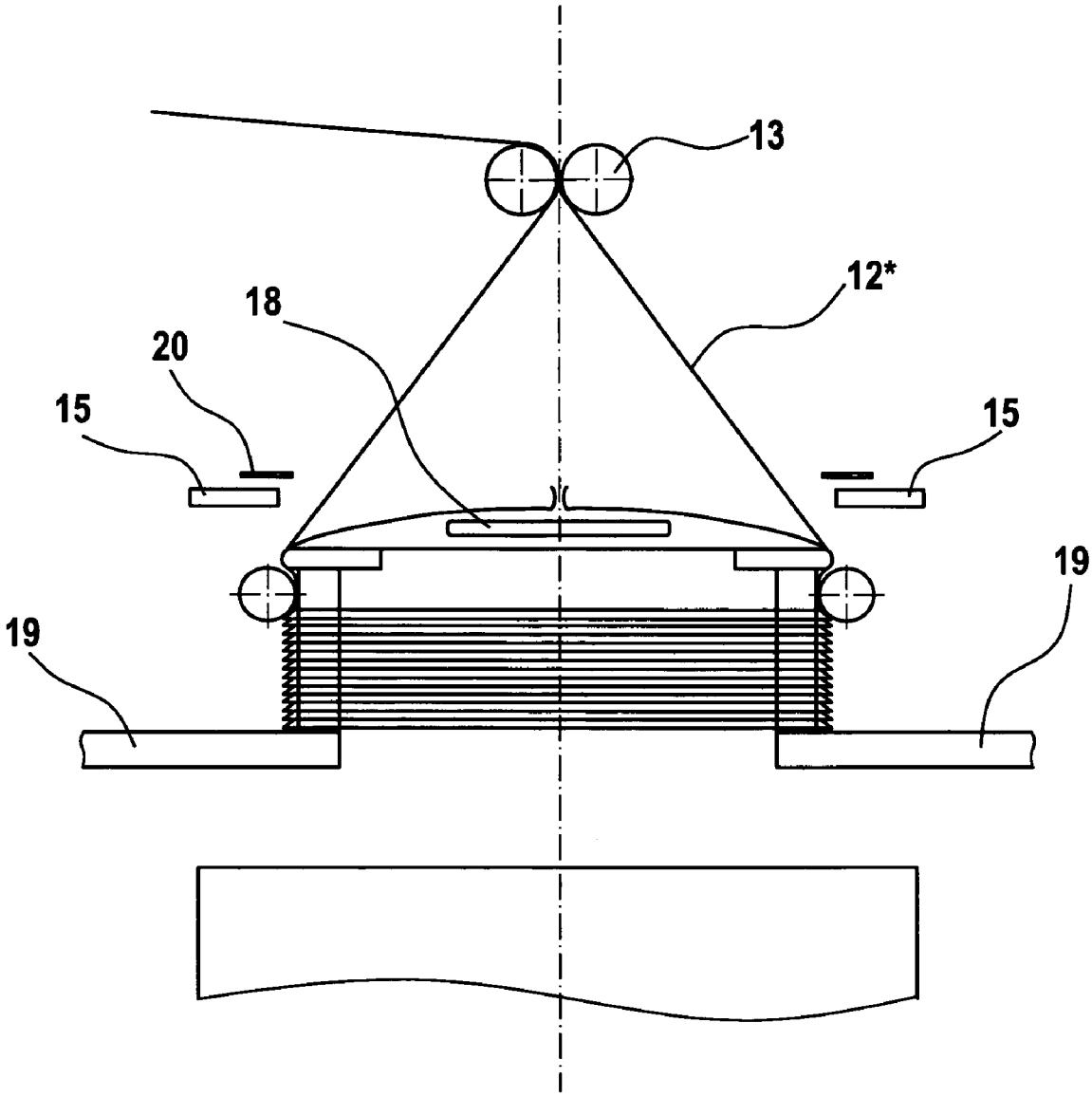
FIG. 11 shows a second working embodiment in which the folds are produced in the roof portion to set fast cycles.
Figure 12:
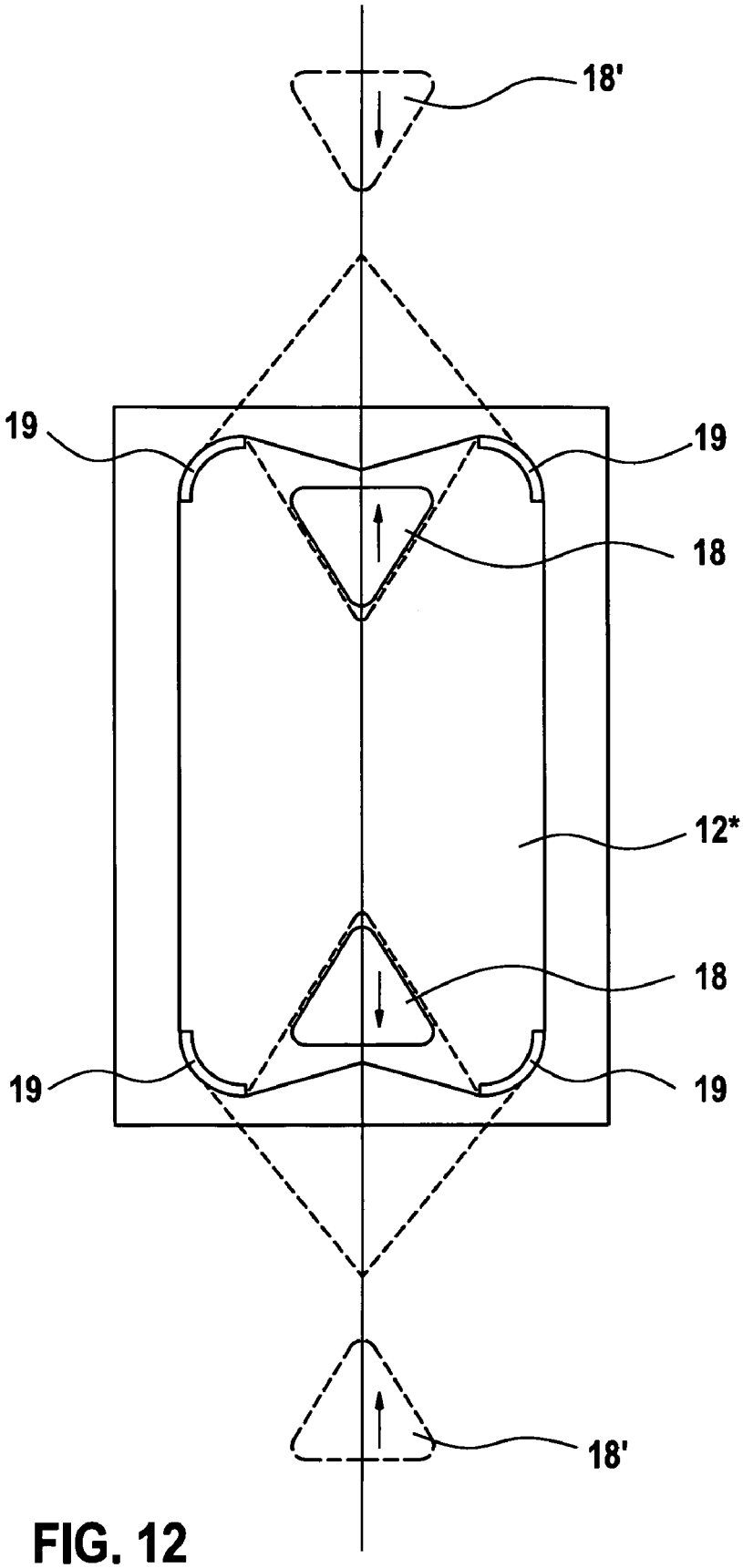
FIG. 12 is a partially sectioned view from above of the second working example.

A second working example operating in a manner akin to the first example is depicted in FIGS. 11 and 12. This working example manages to do without opening up the foil tube for the purpose of folding at a position other than at its tube end and for folding there.

In this working embodiment the foil tube is opened following passing the foil supply rolls 13 and in a known manner the foil tube is reefed onto a drawing over means 19 for the hood to be formed. Following this a generally roof-like form of cross section (roof portion 12*) is constituted. In this in any case opened portion of the foil tube the folds are also made. For this purpose just above the drawing over means 19 from both sides wedge-like folding members 18 are thrust into the roof portion 12* forcing same to folded inward in a V-shaped crease. The position of the folding members 18 and the folded in foil portion are indicated in chained lines in FIG. 12. Following this the means 15, which in the present case are in the form of welding beams for sealing the foil tube, are moved together. They entrain the foil of the roof portion 12* with them, thrust it together inward and thereby also catch the two V-shaped inwardly directed creases in the foil, which accordingly are folded respectively inward to produce a V-shaped fold. Then the V-shaped folds are weld to the foil in contact with them and accordingly secured in position. After this the foil hood is cut off by means of a knife 20 moving along the welding beam. The completed foil hood foil may now as usual be stretched, drawn over the goods and shrunk. The folding members 18 are wedge-shaped here and their points are inwardly direct toward the middle of the foil tube. This favors the inward folding of the foil. Ideally the acute angle "W" is between 55 and 85 degrees and may possibly be adjustable, i. e. it is able to be reset, for example in accordance with the foil thickness and strength. This means that there is a satisfactory inward creasing without the foil being substantially overloaded by having an excessive size of the point.

Figure 13:
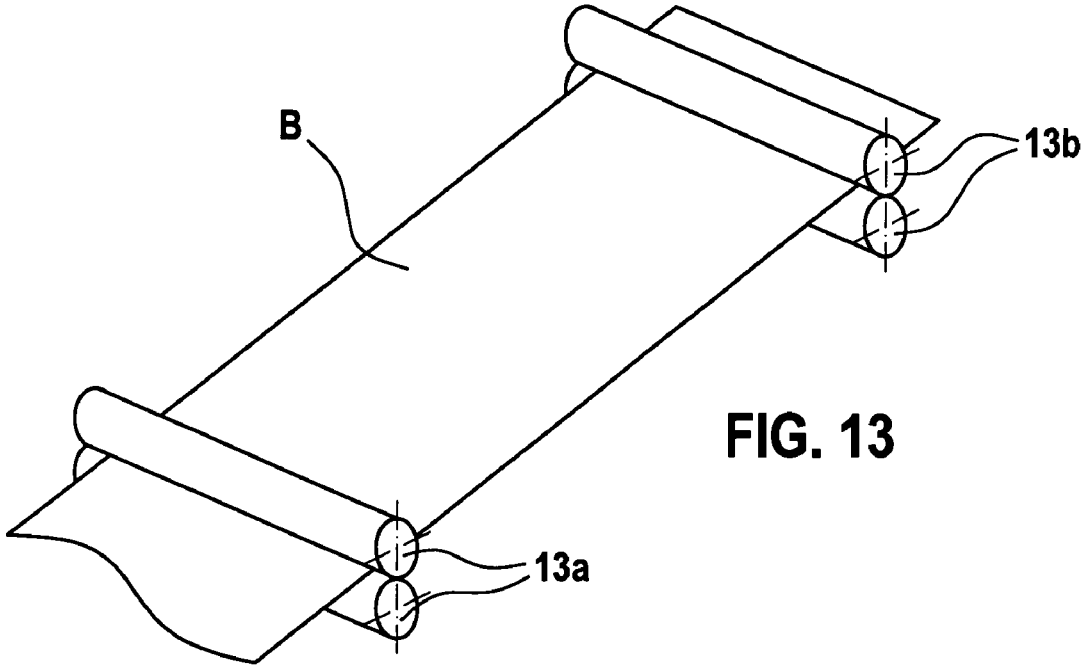
FIG. 13 shows a third working embodiment rendering possible folding in a continuous method but in a position before engagement of the folding plates to act on the tube.
Figure 14:
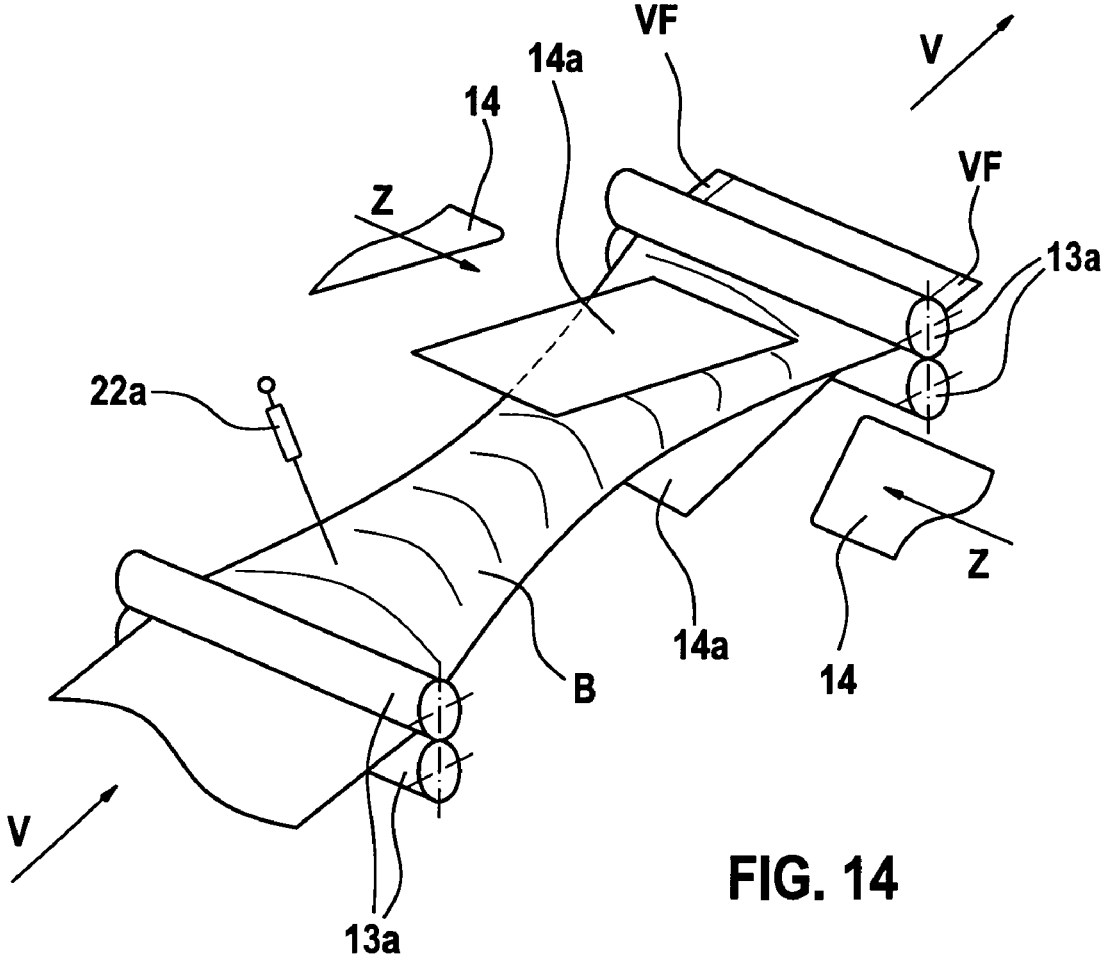
FIG. 14 shows the third embodiment at the start of a shift or exchange of the supply roll for the foil tube.

A third working example is illustrated in FIGS. 13 and 14. In this example of the invention there is a provision such that in the course of being drawn off a supply the flat tube is continuously (i.e. in a continuous process) laterally folded inward so that it is provided with side V-shaped folds "FV" along its entire length of the type in question here before it enters the machine in which sealing of the foil tube and cutting off the hood and hooding the goods takes place. The folding operation takes place using a hood stretching or hood shrink apparatus which is the same as in the previously described example of the invention in the absence of any indication to the contrary. The apparatus in any case includes two pairs of rolls 13*a* and 13*b*. Preferably one respective roll of the roll pair 13*a* and 13*b* bears a soft yielding and accordingly adequately sealing working layer, whereas the other roll has a smooth periphery and as a rule is of ground metal. They act on the foil located between them from either side with the necessary force.

Following every change of a foil roll the start of the new foil tube is laid between the pairs of rolls 13*a* and 13*b*. Then the rolls of each pair of rolls are shifted toward each other so that the tube portion located between the pairs 13*a* and 13*b* of rolls is practically completely closed. The machine operator now blows in air (for example by inserting a jet 22*a* piercing the foil) in certain amount into the closed tube portion so that the tube now balloons out. The hole employed air injection is sealed off, f. i. using adhesive film. The initial inflation of the tube portion to be implemented may take place automatically, though as a rule it will be performed by the machine minder in order to simplify the apparatus. Given a suitable selection of the coating of the pairs of rolls 13*a* and 13*b* and of their pressing force air leaks will be reduced practically to zero. The tube portion B only then has to be inflated following each roll change only once over, something which can be done by hand without any difficulty.

Figure 15:
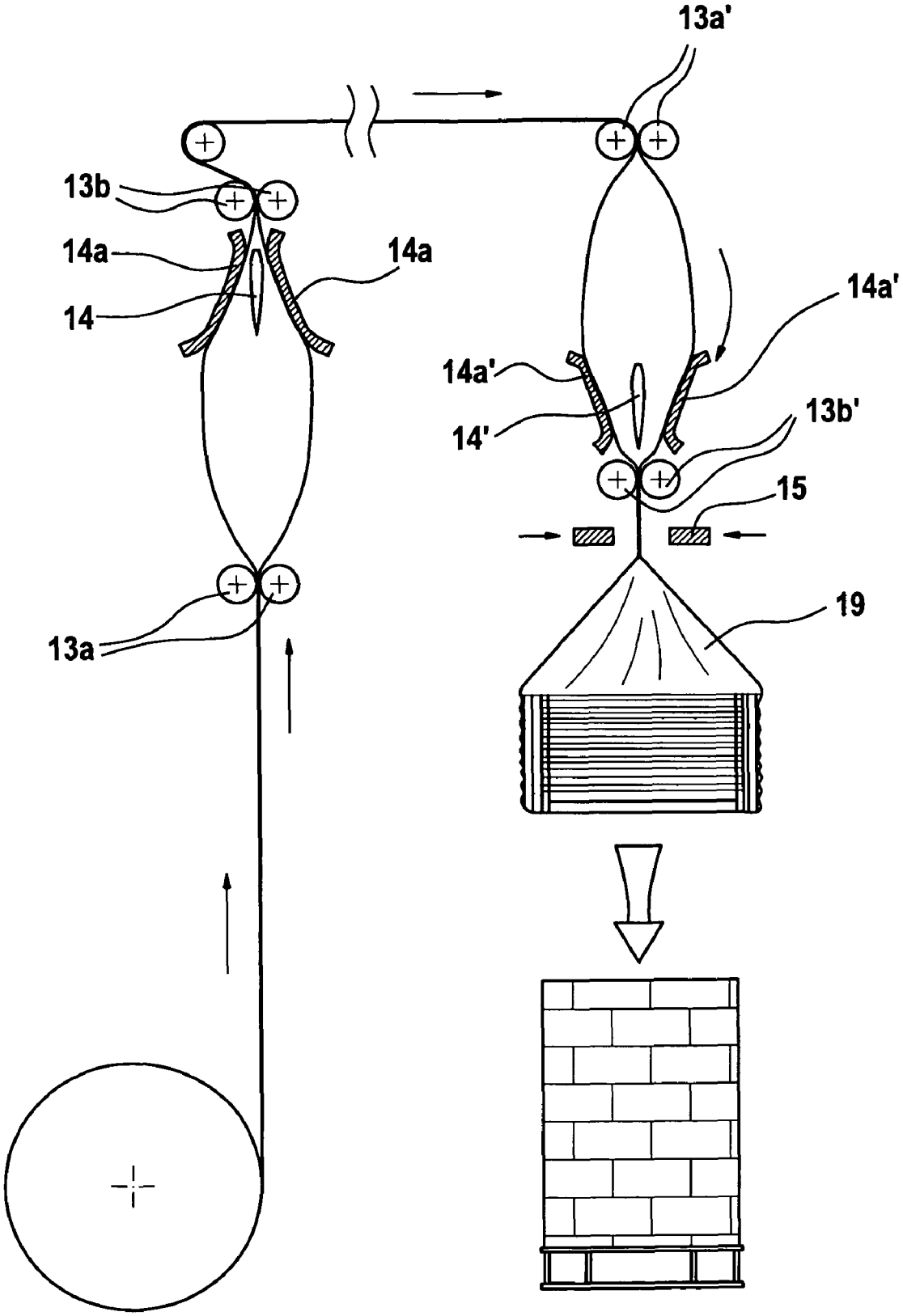
FIG. 15 is a diagram of the plant in the third working embodiment.

More particularly in the case of apparatus which is kept running for long periods between roll changing owing to their large rolls it may be advantageous to have three rolls 13*b* in lieu of two rolls. The decisive point is to intensify the contact between the rolls and the foil at the sealing point by bending and thus perfecting the closing action and so avoiding stopping the apparatus from time to time for the purpose of replenishing the balloon of air. FIG. 15 shows such a set of three rolls on the top on the left. For other corresponding pairs of rolls (such as 13*b*) the same observations apply. Sets of four rolls are also possible.

From either side the folding wedges or swords are now moved in which thrust the ballooning tube portion B inward at least in parts thereof to form V-shaped folds and for this purpose preferably define a funnel-like portion B through which the ballooning tube portion runs toward the pair 13*b* of rolls. Preferably (in the present case in a plane arranged approximately perpendicularly) in addition guide faces 14*a* are shifted toward the foil balloon. These guides 14*a* do not induce any fold formation and instead prevent the balloon being displaced by the folding wedges 14 or deformed in an undesired manner. The guides also preferably delimit a funnel-like configuration between them through which the ballooning tube portion moves toward the pair 13*b* of rolls. Then the foil feed is started so that the foil tube is moved in the direction of the arrows V. The sides of the foil tube then slide along the activated folding wedges 14 and are continuously "prefolded" in a V-shape (not explicitly illustrated). As soon as the tube pretreated in this manner is pulled between the rolls of the pair 13*b*, its prefolded portions will be neatly folded up in a V-shape. The foil tube entering the part between the roll pairs 13*a* and 13*b* will leave the part between the roll pairs 13*a* and 13*b* therefore as a laterally folded foil tube, i. e. it is provided with V-shaped folds "VF", which however lie somewhat further down than as indicated in FIG. 14 for the purpose of mere illustration, since the tube generally becomes narrower owing to folding.

When in this case there is a mention of feed movement of the folding wedges 14, this is only an optional feature for facilitating foil change. The guides and the folding wedges can instead be mounted in a fixed manner or in a manner allowing shifting for adjustment purposes only.

Although the rolls in the pairs (with the foil between them) roll against each other the trapped compressed air will not leak away. Instead of such leakage it is possible to say that the air is "pumped around" out of the portion of the foil tube and about to leave the portion of the foil tube between the rolls of the roll pair 13*a* and 13*b* and enter the portion of the foil tube, such air moving via the rolls of the roll pair 13*a* and entering for the first time the portion between the roll pairs 13*a* and 13*b*.

It is also to be noted that the roll pairs 13*a* and 13*b*, differing from the example in FIGS. 13 and 14, as a rule will not include a horizontal plane between them. As shown in FIG. 15 they are so arranged in the machine that they include a generally vertical plane between them, namely in the upwardly slanting portion, in which the flat tube, after being drawn off from the stock, is directed upwardly in the machine in order to then be drawn off downward as a hood to be placed on the goods to be wrapped, or instead of this is directed in the descending portion downward to the goods to be wrapped in the, the tube coming from above. FIG. 15 illustrates these two alternatives in a single showing. In the left hand figure half show how the means, depicted in FIGS. 13 and 14, for folding (12*a*, 13*b*, 14 and 14*a*) is accommodated in the ascending portion of the machine. If it is accommodated here the machine may be designed in an extremely compact fashion, since an overall space which is otherwise only employed to a minor extent, is made use of and since (something which is important in hood shrink machines) the inflated and accordingly easily damaged foil portion is held outside the heating zone. As an alternative the means for folding (13*a*', 13*b*', 14 and 14*a*') may be also arranged in the descending part of the machine in the vicinity of the goods to be wrapped.

The invention claimed is:

1. A method for disposing goods within a hood so as to be wrapped or packaged, comprising the steps of:

drawing off a length of a flattened tubular member, within which the goods are to be wrapped, from a supply roll, wherein said flattened tubular member effectively comprises two webs integrally connected to each other at two oppositely disposed longitudinally extending side edge portions thereof such that said two webs are disposed in surface-to-surface contact with each other over the entire transverse width dimension of said flattened tubular member;

expanding said flattened tubular member so as to cause said two webs, integrally connected to each other at said side edge portions thereof, to be moved away from each other such that said two webs are no longer disposed in surface-to-surface contact with each other over the entire width dimension of said flattened tubular member;

engaging folding devices with said two oppositely disposed longitudinally extending side edge portions of said expanded tubular member;

moving said folding devices toward each other so as to fold said expanded tubular member inwardly at said two oppositely disposed longitudinally extending side edge portions thereof so as effectively define two V-shaped folds at said two oppositely disposed longitudinally extending side edge portions thereof wherein apex portions of said two V-shaped folds will now extend toward each other and toward the middle of said expanded tubular member so as to define two new oppositely disposed longitudinally extending side edge portions of said expanded tubular member having said V-shaped folds interposed therebetween, said folding devices being moved toward each other in directions which are substantially parallel to said transverse width dimension of said flattened tubular member, and contracting said expanded tubular member in conjunction with moving said folding devices toward each other;

using sealing means to seal said expanded tubular member after said folding devices have formed said V-shaped folds at said two oppositely disposed longitudinally extending side edge portions of said expanded tubular member so as to form said hood such that said two new oppositely disposed longitudinally extending side edge portions of said expanded tubular member, within the vicinity of said sealing means, will no longer have its two webs disposed in surface-to-surface contact with each other but will include said V-shaped folds therebetween; and severing said hood from residual flattened tubular member disposed upon said supply roll at a location interposed between said sealing location and said supply roll.

2. The method as set forth in claim 1, wherein:

said flattened tubular member is expanded in a direction which is substantially perpendicular to planes within which said two webs are initially disposed prior to expansion of said flattened tubular member.

3. The method as set forth in claim 1, further comprising the step of:

using expanding means, for expanding said flattened tubular member, which is fixed at a predetermined location such that the size of said two V-shaped folds defined at said two oppositely disposed longitudinally extending side edge portions of said expanded tubular member have a predetermined size.

4. The method as set forth in claim 1, further comprising the steps of:

partially drawing said hood over the goods before said folding members form said V-shaped folds at said two oppositely disposed longitudinally extending side edge portions of said expanded tubular member; and completely drawing said hood over the goods after said sealing and severing steps.

5. The method as set forth in claim 1, further comprising the step of:

drawing said hood over the goods after said sealing and severing steps.

6. The method as set forth in claim 1, further comprising the steps of:

forming a roof portion within said hood; and engaging said roof portion with said folding devices so as to form said V-shaped folds within said roof portion of said hood.

7. The method as set forth in claim 1, further comprising the steps of:

expanding said flattened tubular member by forming a ballooned portion within said flattened tubular member; and using guide members in conjunction with said folding devices so as to form said two new oppositely disposed longitudinally extending side edge portions of said expanded tubular member having said V-shaped folds interposed therebetween.

8. A method for disposing goods within a hood so as to be wrapped or packaged, comprising the steps of:

drawing off a length of a flattened tubular member, within which the goods are to be wrapped, from a supply roll, wherein said flattened tubular member effectively comprises two webs integrally connected to each other at two oppositely disposed longitudinally extending side edge portions thereof such that said two webs are disposed in surface-to-surface contact with each other over the entire transverse width dimension of said flattened tubular member;

expanding said flattened tubular member so as to cause said two webs, integrally connected to each other at said side edge portions thereof, to be moved away from each other such that said two webs are no longer disposed in surface-to-surface contact with each other over the entire width dimension of said flattened tubular member;

engaging folding devices with said two oppositely disposed longitudinally extending side edge portions of said expanded tubular member;

moving said folding devices toward each other so as to fold said expanded tubular member inwardly at said two oppositely disposed longitudinally extending side edge portions thereof so as effectively define two V-shaped folds at said two oppositely disposed longitudinally extending side edge portions thereof wherein apex portions of said two V-shaped folded will now extend toward each other and toward the middle of said expanded tubular member so as to define two new oppositely disposed longitudinally extending side edge portions of said expanded tubular member having said V-shaped folds interposed therebetween;

using sealing means to seal said expanded tubular member after said folding devices have formed said V-shaped folds at said two oppositely disposed longitudinally extending side edge portions of said expanded tubular member so as to form said hood such that said two new oppositely disposed longitudinally extending side edge portions of said expanded tubular member, within the vicinity of said sealing means, will no longer have its two webs disposed in surface-to-surface contact with each other but will include said V-shaped folds therebetween; and severing said hood from residual flattened tubular member disposed upon said supply roll at a location interposed between said sealing location and said supply roll; and using expanding means, for expanding said flattened tubular member, which are movable in directions which are substantially parallel to said transverse width dimension of said flattened tubular member such that the size of said two V-shaped folds defined at said two oppositely disposed longitudinally extending side edge portions of said expanded tubular member can be variably adjusted.

9. Apparatus for disposing goods within a hood so as to be wrapped or packaged, comprising:

a supply roll containing a supply of a flattened tubular member within which goods are to be wrapped, wherein said flattened tubular member effectively comprises two webs integrally connected to each other at two oppositely disposed longitudinally extending side edge portions thereof such that said two webs are disposed in surface-to-surface contact with each other over the entire transverse width dimension of said flattened tubular member;

means for drawing off a length of the flattened tubular member from said supply roll;

means for expanding said flattened tubular member so as to cause said two webs, integrally connected to each other at said side edge portions thereof, to be moved away from each other such that said two webs are no longer disposed in surface-to-surface contact with each other over the entire width dimension of said flattened tubular member;

folding means, engaged with said two oppositely disposed longitudinally extending side edge portions of said expanded tubular member, for folding said expanded tubular member inwardly at said two oppositely disposed longitudinally extending side edge portions thereof, as said folding means are moved toward each other, so as effectively define two V-shaped folds at said two oppositely disposed longitudinally extending side edge portions thereof wherein apex portions of said two V-shaped folds will now extend toward each other and toward the middle of said expanded tubular member so as to define two new oppositely disposed longitudinally extending side edge portions of said expanded tubular member having said V-shaped folds interposed therebetween;

wherein said folding means are movable toward each other in directions which are substantially parallel to said transverse width dimension of said flattened tubular member, and said expanding means are movable with respect to each other and toward each other, in a direction which is substantially perpendicular to planes within which said two webs are initially disposed prior to expansion of said flattened tubular member, so as to contract said flattened tubular member in conjunction with said movement of said folding means toward each other;

sealing means for sealing said expanded tubular member after said folding devices have formed said V-shaped folds at said two oppositely disposed longitudinally extending side edge portions of said expanded tubular member so as to form said hood such that said two new oppositely disposed longitudinally extending side edge portions of said expanded tubular member, within the vicinity of said sealing means, will no longer have its two webs disposed in surface-to-surface contact with each other but will include said V-shaped folds therebetween;

means for severing said hood from residual portions of said flattened tubular member disposed upon said supply roll at a location interposed between said sealing location and said supply roll; and means for applying said hood over the goods to be wrapped within said hood.

10. The apparatus as set forth in claim 9, wherein:

said expanding means are movable with respect to each other and away from each other, in a direction which is substantially perpendicular to planes within which said two webs are initially disposed prior to expansion of said flattened tubular member, so as to expand said flattened tubular member.

11. The apparatus as set forth in claim 9, wherein:

said folding means comprises a pair of folding plate members.

12. The apparatus as set forth in claim 11, wherein:

said pair of folding plate members have wedge-shaped configurations.

13. The apparatus as set forth in claim 9, further comprising:

said expanding means, for expanding said flattened tubular member, is fixed at a predetermined location such that the size of said two V-shaped folds defined at said two oppositely disposed longitudinally extending side edge portions of said expanded tubular member have a predetermined size.

14. The apparatus as set forth in claim 9, further comprising:

means for forming a roof portion within said hood;

said folding means engage said roof portion of said hood so as to form said V-shaped folds within said roof portion of said hood.

15. The apparatus as set forth in claim 9, wherein:

said means for expanding said flattened tubular member comprises means for forming a ballooned portion within said flattened tubular member; and guide members are disposed in conjunction with said folding means so as to form said two new oppositely disposed longitudinally extending side edge portions of said expanded tubular member having said having said V-shaped folds interposed therebetween.

16. An apparatus: for disposing goods within a hood so as to be wrapped or packaged, comprising:

a supply roll containing a supply of a flattened tubular member within which goods are to be wrapped, wherein said flattened tubular member effectively comprises two webs integrally connected to each other at two oppositely disposed longitudinally extending side edge portions thereof such that said two webs are disposed in surface-to-surface contact with each other over the entire transverse width dimension of said flattened tubular member;

means for drawing off a length of the flattened tubular member from said supply roll;

means for expanding said flattened tubular member so as to cause said two webs, integrally connected to each other at said side edge portions thereof, to be moved away from each other such that said two webs are no longer disposed in surface-to-surface contact with each other over the entire width dimension of said flattened tubular member, said expanding means, for expanding said flattened tubular member, being movable in directions which are substantially parallel to said transverse width dimension of said flattened tubular member such that the size of said two V-shaped folds defined at said two oppositely disposed longitudinally extending side edge portions of said expanded tubular member can be variably adjusted;

folding means, engaged with said two oppositely disposed longitudinally extending side edge portions of said expanded tubular member, for folding said expanded tubular member inwardly at said two oppositely disposed longitudinally extending side edge portions thereof, as said folding means are moved toward each other, so as effectively define two V-shaped folds at said two oppositely disposed longitudinally extending side edge portions thereof wherein apex portions of said two V-shaped folded will now extend toward each other and toward the middle of said expanded tubular member so as to define two new oppositely disposed longitudinally extending side edge portions of said expanded tubular member having said V-shaped folds interposed therebetween;

sealing means for sealing said expanded tubular member after said folding devices have formed said V-shaped folds at said two oppositely disposed longitudinally extending side edge portions of said expanded tubular member so as to form said hood such that said two new oppositely disposed longitudinally extending side edge portions of said expanded tubular member, within the vicinity of said sealing means, will no longer have its two webs disposed in surface-to-surface contact with each other but will include said V-shaped folds therebetween;

means for severing said hood from residual portions of said flattened tubular member disposed upon said supply roll at a location interposed between said sealing location and said supply roll; and means for applying said hood over the goods to be wrapped within said hood.

* * * * *